US009799937B2

(12) United States Patent
Deleniv et al.

(10) Patent No.: US 9,799,937 B2
(45) Date of Patent: Oct. 24, 2017

(54) WAVEGUIDE E-PLANE FILTER STRUCTURE

(71) Applicant: Telefonaktiebolaget L M Ericsson (publ), Stockholm (SE)

(72) Inventors: Anatoli Deleniv, Mölndal (SE); Piotr Kozakowski, Göteborg (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 13 days.

(21) Appl. No.: 14/781,808

(22) PCT Filed: Apr. 2, 2013

(86) PCT No.: PCT/EP2013/056942

§ 371 (c)(1),
(2) Date: Oct. 1, 2015

(87) PCT Pub. No.: WO2014/161567

PCT Pub. Date: Oct. 9, 2014

(65) Prior Publication Data

US 2016/0043457 A1 Feb. 11, 2016

(51) Int. Cl.
*H01P 5/12* (2006.01)
*H01P 1/201* (2006.01)
(Continued)

(52) U.S. Cl.
CPC ..... *H01P 1/201* (2013.01); *H01P 1/207* (2013.01); *H01P 1/2016* (2013.01); *H01P 1/2138* (2013.01)

(58) Field of Classification Search
CPC ..... H01P 1/20; H01P 1/201; H01P 1/2016; H01P 1/207; H01P 1/2138; H01P 7/06
(Continued)

(56) References Cited

U.S. PATENT DOCUMENTS 3,914,713 A 10/1975 Konishi
6,657,520 B2 * 12/2003 Mack ..... H01P 1/207 333/208
(Continued)

FOREIGN PATENT DOCUMENTS

WO 2011134497 A1 11/2011

OTHER PUBLICATIONS

Liao, Shaowei et al., "Neural-Network Modeling for 3-D Substructures Based on Spatial EM-Field Coupling in Finite-Element Method", IEEE Transactions on Microwave Theory and Techniques, vol. 59, No. 1, Jan. 2011, pp. 21-38.
(Continued)

*Primary Examiner* — Robert Pascal
*Assistant Examiner* — Kimberly Glenn
(74) *Attorney, Agent, or Firm* — Murphy, Bilak & Homiller, PLLC

(57) ABSTRACT

The present invention relates to a waveguide E-plane filter component comprising a first and second main part (2) with a corresponding first and second waveguide section part (3). The main parts (2) are mounted to each other, such that a waveguide arrangement is formed. The waveguide arrangement has a height and a width. The waveguide E-plane filter component further comprises at least one electrically conducting foil (10, 11) that is placed between the main parts (3), said foil comprising a filter part (25) with apertures (12*a*, 12*b*, 12*c*, 12*d*). Each pair of adjacent apertures is separated by a corresponding foil conductor (13*a*, 13*b*, 13*c*) of which at least one is constituted by a tuning foil conductor (13*a*) that has a first, second and third part (14, 16, 18) with a corresponding first, second and third width (15, 17, 19).

4 Claims, 4 Drawing Sheets

(51) Int. Cl.
*H01P 1/207* (2006.01)
*H01P 1/213* (2006.01)

(58) Field of Classification Search
USPC ..... 333/135
See application file for complete search history.

(56) References Cited

U.S. PATENT DOCUMENTS 6,876,277 B2 * 4/2005 Cooper ..... H01P 1/207 333/208
7,456,711 B1 * 11/2008 Goldsmith ..... H01P 1/207 333/209
9,019,047 B2 * 4/2015 Kozakowski ..... H01P 1/2016 333/208
9,472,836 B2 * 10/2016 Deleniv ..... H01P 1/2016

OTHER PUBLICATIONS

Saad, A. M. K., "Planar Integrated Microwave Components for Terrestrial and Satellite Application", IEEE MTT-S Digest, 1985, pp. 175-177.
Mansour, R. R. et al., "Analysis and Design of Extracted Pole E-Plane Filters", Microwave and Optical Technology Letters, vol. 2, No. 8, Aug. 1989, pp. 286-291.

* cited by examiner

Section A-A

WAVEGUIDE E-PLANE FILTER STRUCTURE

TECHNICAL FIELD

The present invention relates to a waveguide E-plane filter component comprising a first main part which in turn comprises a first waveguide section part, and a second main part which in turn comprises a second waveguide section part. The main parts are mounted to each other, each waveguide section part comprising a bottom wall, corresponding side walls and an open side. The open side of the first waveguide section part is arranged to face the open side of the second waveguide section part such that a waveguide arrangement is formed. The waveguide arrangement has a waveguide height between the bottom walls and a waveguide width between the side walls. The waveguide E-plane filter component further comprises at least one electrically conducting foil that is placed between the first main part and the second main part, the foil comprising a filter part that runs between the waveguide section parts. The filter part comprises apertures in the foil, where each pair of adjacent apertures is separated by a corresponding foil conductor having a longitudinal extension that runs along the waveguide width.

BACKGROUND

When designing microwave circuits, transmission lines are commonly used. A transmission line is normally formed on a dielectric carrier material. Due to losses in the dielectric carrier material, it is sometimes not possible to use any transmission lines. When there for example is a filter component in the layout, it may have to be realized in waveguide technology. Waveguides are normally filled with air or other low-loss materials.

Despite quite impressive progress demonstrated in the last few decades in the microwave engineering area, the important role of waveguide components remains undisputed, this is due to their low loss and high power capability performance.

A waveguide E-plane filter component normally comprises two main parts, a first main part comprising a first waveguide section part and a second main part comprising a second waveguide section part. Each waveguide section part comprises three walls; a bottom and corresponding sides.

The first main part and the second main part are arranged to be mounted together such that the first waveguide section part and the second waveguide section part face each other, and together constitute a resulting waveguide section part. This means that each main part comprises a half-height waveguide section part where, when mounted together, the resulting waveguide section part constitutes a full-height waveguide section part.

The electromagnetic field propagates parallel to the intersection. Since the waveguide section part normally have equal sizes, and thus the same height of the corresponding sides, the dominant $TE_{10}$ mode of the electromagnetic field has its maximum magnitude at said intersection.

Between the main parts, at the intersection, an electrically conducting foil is placed, having a filter part comprising full height or partial-height apertures. The filter part runs between the waveguide section parts.

In order to improve the spectral selectivity and stop-band attenuation, a class of filters for which an amplitude transfer function has attenuation poles at finite frequencies is used. The transmission zeros, attenuation poles, at finite frequencies can be introduced by cross-coupling resonant cavities. Since this solution is not always realizable, the transmission zeroes at the finite frequencies can by introduced using band-stop resonators. Each band-stop resonator allows one to realize one transmission zero either below or above the pass-band of the filter. An E-plane band-stop resonator is usually realized in the form of a T-junction with one port being short-circuited. Such a T-junction is comprised in the main parts with the conductive foil disposed in between the main parts, realizing the coupling between the band-stop cavity and the rest of the E-plane filter.

These T-junctions constitute so-called extracted cavities, allowing realization of said transmission zeroes. These extracted cavities are constituted by relatively small confined openings.

Generally, the benefit of an E-plane filter is that the same main parts can be used for the filters working at different center frequencies and/or covering different bandwidths at different frequency bands. This may be achieved by using the same main parts and change the electrically conducting foil to one having the aperture configuration that provides the desired frequency characteristics.

However, when a waveguide filter design based on E-plane technology is concerned, the relative positions of extracted cavities in the form of said T-junction need to be fixed. The distance between a common port of the waveguide filter and an extracted cavity thus needs to be fixed for a given frequency characteristic of the waveguide filter. This limits the possibility of having the same main parts and replacing the conductive foil disposed between the main parts to realize different filter characteristic.

It has also been proposed to have a foil that comprises at least one foil loop constituted by a foil conductor having a starting point and an end point. The foil conductor is running in a corresponding aperture in the foil. Although advantageous, this arrangement results in an increased length of the foil as well as higher demands on manufacturing processes, especially for small foil loops.

There is thus a desire to obtain a microwave waveguide E-plane filter structure, where the structure may be used for different center frequencies and/or frequency bands by only changing the electrically conducting foil according to the above, but with enhanced properties with respect to prior art.

SUMMARY

The object of the present invention is to present a microwave waveguide E-plane filter structure, where the structure may be used for different center frequencies and/or frequency bands by only changing an electrically conducting foil, but with enhanced properties with respect to prior art.

This object is obtained by means of a waveguide E-plane filter component comprising a first main part which in turn comprises a first waveguide section part, and a second main part which in turn comprises a second waveguide section part. The main parts are mounted to each other, each waveguide section part comprising a bottom wall, corresponding side walls and an open side. The open side of the first waveguide section part is arranged to face the open side of the second waveguide section part such that a waveguide arrangement is formed. The waveguide arrangement has a waveguide height between the bottom walls and a waveguide width between the side walls. The waveguide E-plane filter component further comprises at least one electrically conducting foil that is placed between the first main part and the second main part, the foil comprising a filter part that runs between the waveguide section parts. The filter part comprises apertures in the foil, where each pair of adjacent apertures is separated by a corresponding foil conductor having a longitudinal extension that runs along the waveguide width.

Furthermore, at least one foil conductor is constituted by a tuning foil conductor that has a first part with a first width, a second part with a second width and a third part with a third width. The parts extend along the longitudinal extension and together form said tuning foil conductor. The second part is positioned between the first part and the second part, and the second width exceeds the first width and the second width. The widths extend across the longitudinal extension, where the first part has a first length, the second part has a second length and the third part has a third length. The lengths extend along the longitudinal extension, and the second part is symmetrical with respect to a first symmetry line running along the longitudinal extension. Furthermore, at least one of the first part and the third part is symmetrical with respect to at least one offset symmetry line running parallel to the first symmetry line, where the symmetry lines run parallel to each other and are separated by at least one corresponding distance.

According to another example, at least one of the first part and the second part is symmetrical with respect to at least one offset symmetry line running parallel to the first symmetry line. The symmetry lines run parallel to each other and are separated by at least one corresponding distance.

Other examples are disclosed in the dependent claims.

A number of advantages are obtained by means of the present invention, for example

- Only one type of main parts has to be made for a filter operating in a certain frequency band, leading to lower productions costs and easier logistic handling due to fewer different types of main parts.
- A less expensive versatile filter arrangement is obtained.
- Different types of foils are easily manufactured, stored and handled.
- No length increase of the foil is necessary.
- All parts are fixed, having no loose ends, providing mechanical stability.

BRIEF DESCRIPTION OF THE DRAWINGS

The present invention will now be described more in detail with reference to the appended drawings, where.

DETAILED DESCRIPTION

Figure 1:
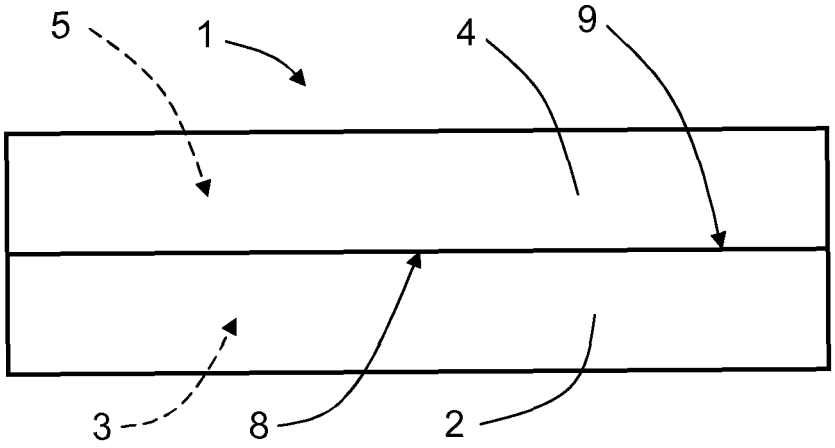
FIG. 1 shows a diplexer comprising a first main part and a second main part.
Figure 2:
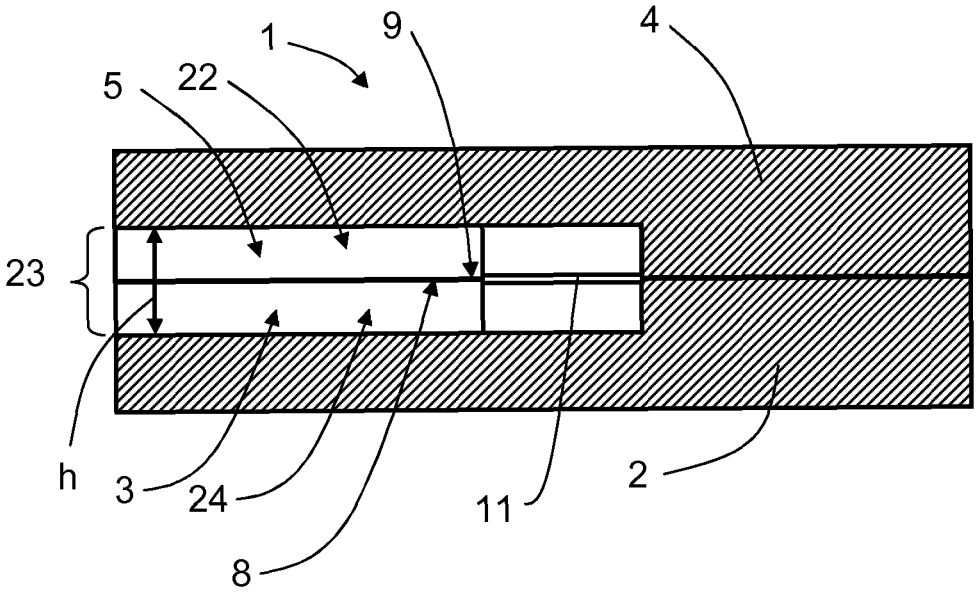
FIG. 2 shows a cross-section of FIG. 1.

With reference to FIG. 1 and FIG. 2, FIG. 2 showing a section of FIG. 1, a waveguide E-plane diplexer 1 comprises a first main part 2, which in turn comprises a first waveguide section part 3, and a second main part 4, which in turn comprises a second waveguide section part 5. The first waveguide section part 3 and the second waveguide section part 5 are only indicated schematically in FIG. 1, and the first waveguide section part 3 will be described more in detail in the following, the second waveguide section part 5 being similar.

As shown in FIG. 1 and FIG. 2, the main parts 2, 4 are arranged to be mounted to each other, the waveguide section parts 3, 5 thus facing each other.

Figure 3:
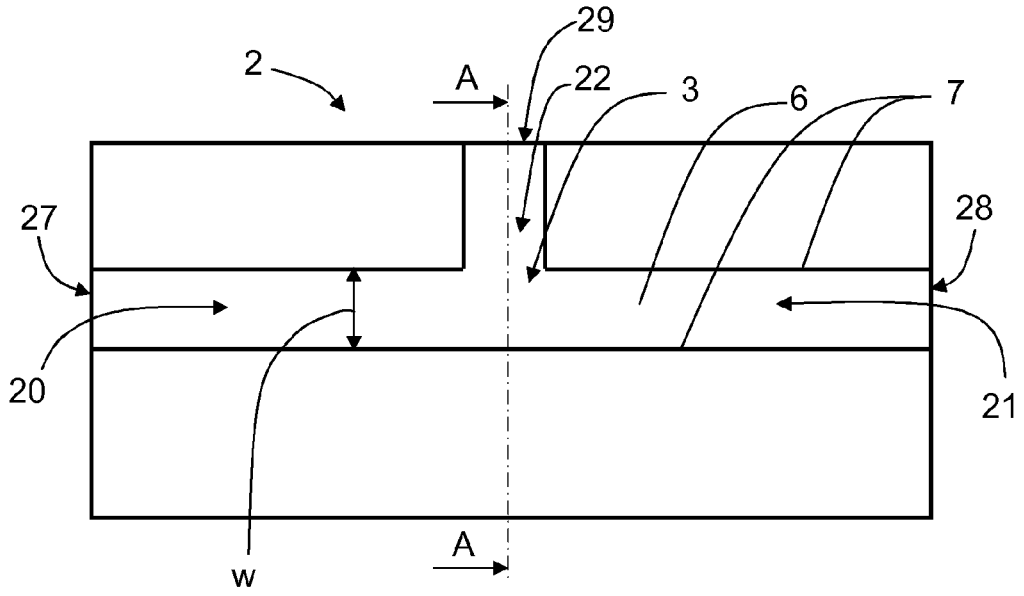
FIG. 3 shows a first main part.
Figure 4:
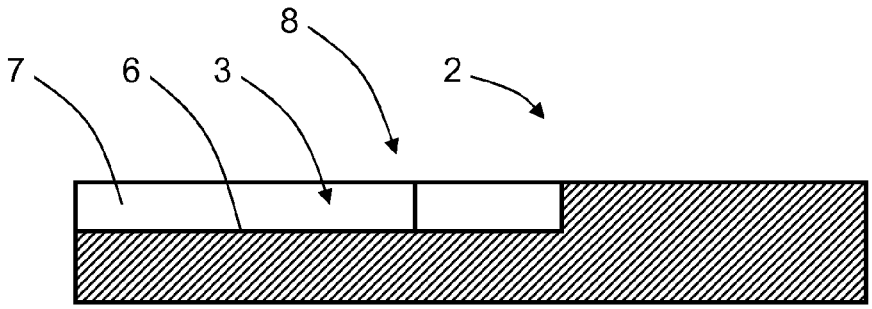
FIG. 4 shows a cross-section of FIG. 3.

With reference to FIG. 3 and FIG. 4, FIG. 4 showing a section of FIG. 3, the first main part 2 will now be described more in detail, and it is to be understood that the second main part 4 has a corresponding appearance. The waveguide section part 3 comprises a bottom wall 6, corresponding side walls 7 and an open side 8, where the open side 8 of the first waveguide section part 3 is arranged to face an open side 9 of the second waveguide section part 5, schematically indicated in FIG. 1 and FIG. 2.

The waveguide section part 3 further comprises a first branch 20 and a second branch 21, these branches 20, 21 being combined to a third branch 22. Corresponding branches constitute the second waveguide section part 5, a corresponding third branch 24 is shown in FIG. 2. When the first main part 2 and the second main part 4 are mounted, these branches face each other such that corresponding combined branches are formed and constitute a waveguide arrangement, as being schematically indicated by the reference number 23 in FIG. 2. In this example, the first branch 20 is associated with a first waveguide port 27, the second branch is associated with a second waveguide port 28 and the third branch 22 is associated with a third waveguide port 29, which for example may constitute an antenna port.

Figure 5:
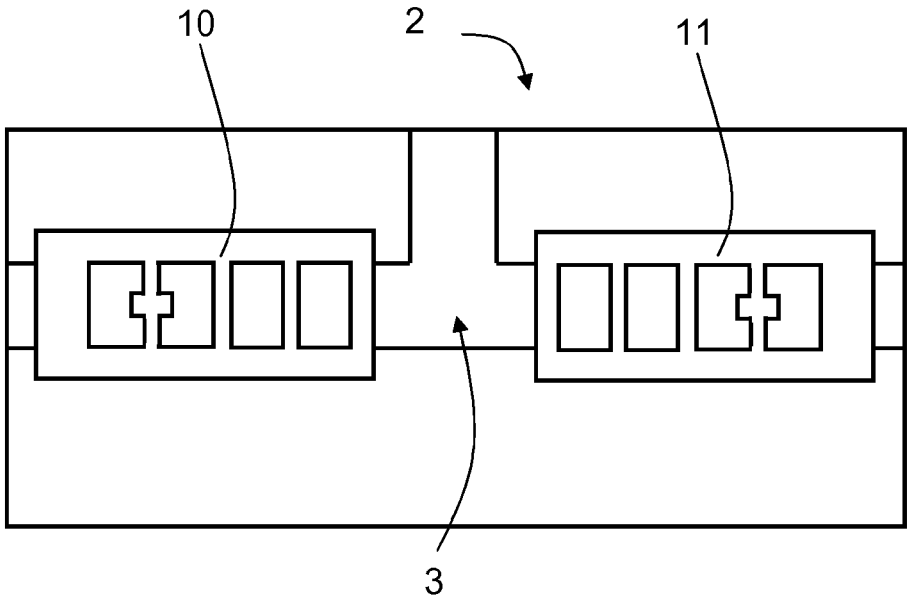
FIG. 5 shows a the first main part with electrically conducting foils.

With reference to FIG. 5, for reasons of clarity only showing the first main part 2, the diplexer 1 further comprises a first electrically conducting foil 10 for the first branch 16 and a second electrically conducting foil 11 for the second branch 17, the electrically conducting foils 10, 11 being arranged to be placed between the first main part 2 and the second main part 4 when the main parts 2, 4 are mounted to each other as shown in FIG. 2, showing the second electrically conducting foil 11 in its position.

Figure 6:
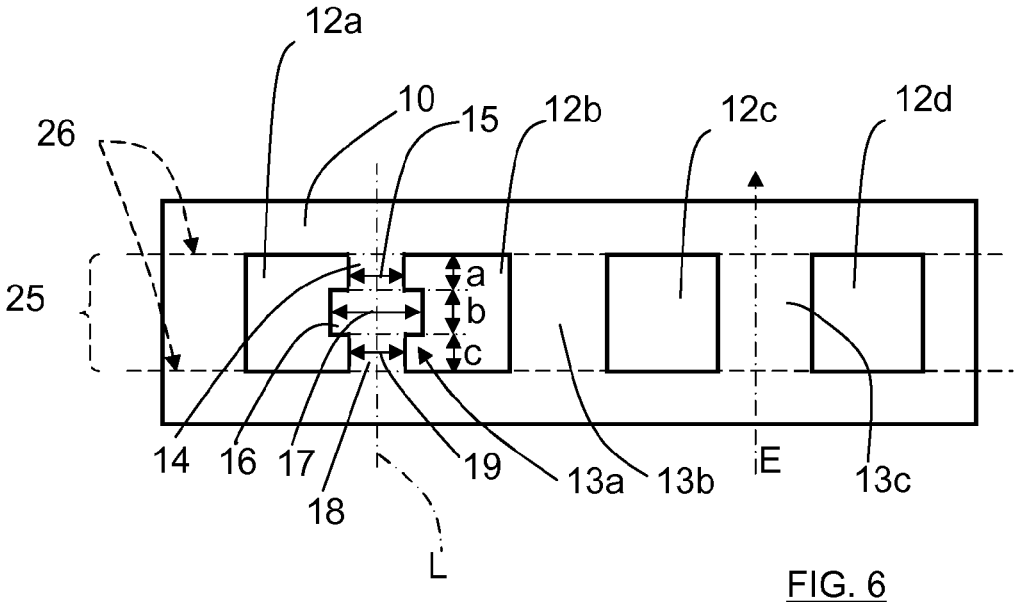
FIG. 6 shows a first type of electrically conducting foil.

With reference also to FIG. 6, showing the first electrically conducting foil 10, the first electrically conducting foil 10 comprises a filter part 25 that is arranged to run between the waveguide section parts 3, 5. The filter part 25 is indicated with dashed lines 26, the dashed lines 26 being intended to follow the side walls 7 when the first electrically conducting foil 10 is mounted to the first main part 2 such that the filter part 25 follows the side walls 7. The first electrically conducting foil 10 comprises apertures 12*a*, 12*b*, 12*c*, 12*d*, and as apparent from FIG. 5, the second electrically conducting foil 11 comprises corresponding apertures. Each pair of adjacent apertures are separated by a corresponding foil conductor 13*a*, 13*b*, 13*c* having a longitudinal extension E that runs along the waveguide width w.

When the first main part 2 and the second main part 4 are mounted, as shown in FIG. 2, the filter part 25 will also follow the side walls of the second waveguide section 5 in a corresponding manner.

With reference to FIGS. 5 and 6, for each electrically conducting foil 10, 11, at least one foil conductor is constituted by a tuning foil conductor 13*a* that has a first part 14 with a first width 15, a second part 16 with a second width 17 and a third part 18 with a third width 19. The parts 14, 16, 18 extend along the longitudinal extension E and together form the tuning foil conductor 13*a* in question.

The second part 16 is positioned between the first part 14 and the second part 18, the second width 17 exceeding the first width 15 and the second width 19, where the widths 15, 17, 19 extend across the longitudinal extension E. In this manner, the tuning foil conductor 13*a* in question acquires a cross-shape.

The first part 14 has a first length a, the second part 16 has a second length b and the third part 18 has a third length c, the lengths a, b, c extending along the longitudinal extension E. In the present invention, at least the second part 16 is symmetrical with respect to a first symmetry line L running along the longitudinal extension E. As shown in FIG. 6, showing an example that is not part of the present invention, all three parts 14, 16, 18 are symmetrically arranged with respect to the first symmetry line L.

Figure 7:
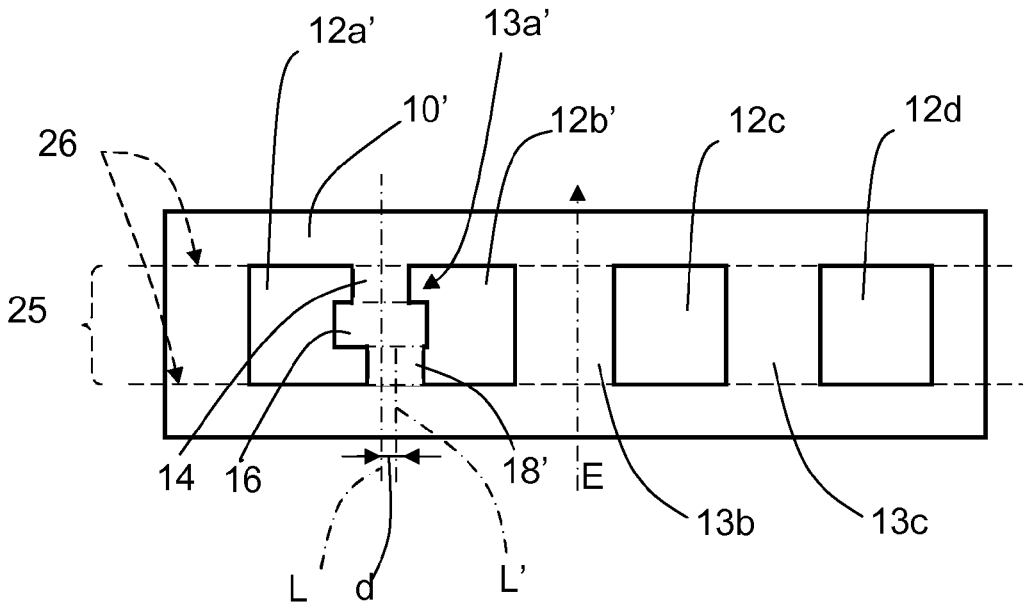
FIG. 7 shows a second type of electrically conducting foil.
Figure 8:
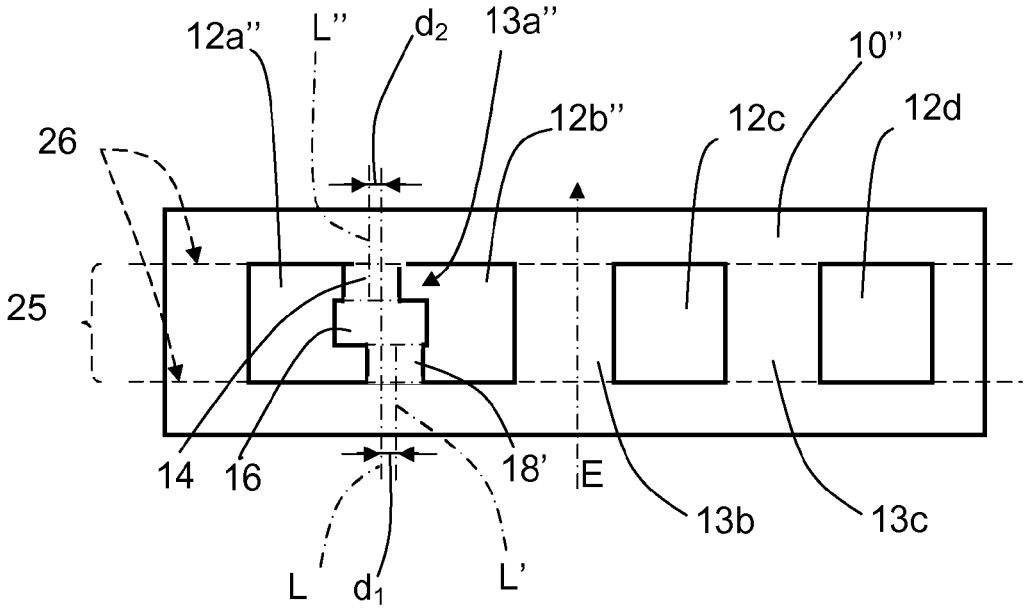
FIG. 8 shows a third type of electrically conducting foil.

In FIG. 7 and FIG. 8, the lengths and widths of the parts 14, 16, 18 are not specifically indicated for reasons of clarity. Of course, the parts 14, 16, 18 have lengths and widths as shown in FIG. 6.

According to the present invention, with reference to FIG. 7, showing an electrically conducting foil 10' according to a second example, an offset third part 18' is symmetrical with respect to a first offset symmetry line L', running parallel to the first symmetry line L. The symmetry lines L, L' run parallel to each other and are separated by a first distance $d_1$. This alternative shape of the tuning foil conductor 13*a'* affects the shape of the adjacent apertures 12*a'*, 12*b'*.

As a further alternative, with reference to FIG. 8, showing an electrically conducting foil 10" according to a another example, in addition to the offset third part 18' disclosed above, an offset first part 16" is symmetrical with respect to a second offset symmetry line L", running parallel to the first symmetry line L. The first symmetry line L and the second offset symmetry line L" run parallel to each other and are separated by a second distance $d_2$. As in the previous example, this alternative shape of the tuning foil conductor 13*a"* affects the shape of the adjacent apertures 12*a"*, 12*b"*. The distances $d_1$, $d_2$ do not have to be equal, and may be of any suitable magnitude.

In FIG. 8, the offsets are shown to run in opposite directions, but the offsets may be directed in any suitable direction across the longitudinal extension E.

This means that one or several of the parts 14, 16, 18 may be offset relative at least on other of the parts across the longitudinal extension E.

By means of this foil conductor arrangement, the same main parts 2, 4 may be used for different frequency bands, and where only the electrically conducting foils 10, 11 will have to be changed for the desired frequency band, and where the electrically conducting foils 10, 11 thus are electrically matched for a certain frequency band. Furthermore, no additional length is added to the diplexer 1.

The present invention is not limited to the examples above, but may vary freely within the scope of the appended claims. For example, the diplexer shown is only one example of a waveguide E-plane filter component that is suitable for the present invention. Other types are easily conceivable for the skilled person, and may for example be single filters, having only one branch or triplexers.

Each electrically conducting foil 10, 11 may have any number and shape of apertures 12*a*, 12*b*, 12*c*, 12*d*, and more than one of the tuning foil conductors.

The lengths a, b, c and widths 15, 17, 18 do not have to have values that are related to each other, and may be of any suitable magnitude for acquiring desired functionality. However, as mentioned previously, the second width 17 exceeds the first width 15 and the second width 19.

The conducting foil 10, 11 may be made in any suitable material such as copper, silver, gold or aluminium. Combinations are also conceivable, such as gold-plated copper.

The main parts 2, 4 may be made in any suitable material such as aluminium or plastics covered with an electrically conducting layer.

In the examples, only one tuning foil conductor is shown for each electrically conducting foil Of course the present invention may not only be used for changing centre frequency and bandwidth of an E-plane waveguide filter in an easy and cost-effective manner, but many other filter characteristics may also be changed by means of the present invention, such as the number of transmission and reflection zeros.

Generally, each tuning foil conductor constitutes a resonator which produces one transmission zero and one reflection zero. This is due to two independent propagation paths of the signal, which at some frequency cancel each other. Structures with such behavior are called singlets or trisections.

The design of each singlet is controlled by a few parameters: couplings $K_{S1}$ and $K_{1L}$, to the main resonator, and $K_{SL}$ that defines the coupling for the parallel propagation path between the source and the load.

The invention claimed is:

1. A waveguide E-plane filter component comprising a first main part which in turn comprises a first waveguide section part, and a second main part which in turn comprises a second waveguide section part, the main parts being mounted to each other, each waveguide section part comprising a bottom wall, corresponding side walls and an open side, where the open side of the first waveguide section part is arranged to face the open side of the second waveguide section part such that a waveguide arrangement is formed, the waveguide arrangement having a waveguide height (h) between the bottom walls and a waveguide width (w) between the side walls, where the waveguide E-plane filter component further comprises at least one electrically conducting foil that is placed between the first main part and the second main part, said foil comprising a filter part that runs between the waveguide section parts, the filter part comprising apertures in said foil, where each pair of adjacent apertures among said apertures is separated by a corresponding foil conductor, each said corresponding foil conductor formed by said foil in said filter part and having a longitudinal extension (E) that runs along the waveguide width (w), wherein at least one of the corresponding foil conductors is constituted by a tuning foil conductor that has a first part with a first width, a second part with a second width and a third part with a third width, the parts extending along the longitudinal extension (E) and together forming said tuning foil conductor, the second part being positioned between the first part and the third part, the second width exceeding the first width and the third width, where the widths extend across the longitudinal extension (E), where the first part has a first length (a), the second part has a second length (b) and the third part has a third length (c), the lengths (a, b, c) extending along the longitudinal extension (E), and where the second part is symmetrical with respect to a first symmetry line (L) running along the longitudinal extension (E), where furthermore at least one of the first part and the third part is symmetrical with respect to at least one offset symmetry line (L', L") running parallel to the first symmetry line (L), where the symmetry lines (L, L', L") run parallel to each other and are separated by at least one corresponding distance ($d_1$, $d_2$).

2. The waveguide E-plane filter component according to claim 1, wherein the waveguide section parts have corresponding at least two branches, and wherein the at least one electrically conducting foil comprises a foil for each branch.

3. The waveguide E-plane filter component according to claim 1, wherein the main parts are made in plastics covered with an electrically conducting layer.

4. The waveguide E-plane filter component according to claim 1, wherein the conducting foil mainly is made in copper, silver, gold or aluminum.

* * * * *